US011020780B2

(12) United States Patent
Ueoka et al.

(10) Patent No.: US 11,020,780 B2
(45) Date of Patent: Jun. 1, 2021

(54) PRODUCTION EQUIPMENT LINE FOR HOT-ROLLED STEEL STRIP AND PRODUCTION METHOD FOR HOT-ROLLED STEEL STRIP

(71) Applicant: JFE Steel Corporation, Tokyo (JP)

(72) Inventors: Satoshi Ueoka, Tokyo (JP); Yuta Tamura, Tokyo (JP); Sonomi Shirasaki, Tokyo (JP); Yukako Katayama, Tokyo (JP); Takashi Matsumoto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 334 days.

(21) Appl. No.: 16/072,968

(22) PCT Filed: Jan. 16, 2017

(86) PCT No.: PCT/JP2017/001192
§ 371 (c)(1),
(2) Date: Jul. 26, 2018

(87) PCT Pub. No.: WO2017/130767
PCT Pub. Date: Aug. 3, 2017

(65) Prior Publication Data

US 2019/0039106 A1 Feb. 7, 2019

(30) Foreign Application Priority Data

Jan. 27, 2016 (JP) ..... JP2016-013537

(51) Int. Cl.
*B21B 1/26* (2006.01)
*B21B 45/02* (2006.01)
(Continued)

(52) U.S. Cl.
CPC ..... *B21B 1/26* (2013.01); *B21B 37/74* (2013.01); *B21B 45/02* (2013.01);
(Continued)

(58) Field of Classification Search
CPC .... B21B 1/32; B21B 1/30; B21B 1/34; B21B 1/24; B21B 1/26; B21B 37/74;
(Continued)

(56) References Cited

U.S. PATENT DOCUMENTS 5,502,881 A * 4/1996 Gaydoul ..... B05B 3/027 29/81.08
5,540,074 A * 7/1996 Smith ..... B21B 1/34 134/122 R
(Continued)

FOREIGN PATENT DOCUMENTS

CN 1864878 A 11/2006
CN 1883835 A 12/2006
(Continued)

OTHER PUBLICATIONS

Extended European Search Report for European Application No. 17 743 998.1, dated Jan. 2, 2019—7 pages.
(Continued)

*Primary Examiner* — Adam J Eiseman
*Assistant Examiner* — Bobby Yeonjin Kim
(74) *Attorney, Agent, or Firm* — RatnerPrestia

(57) ABSTRACT

A production equipment line for a hot-rolled steel strip comprises a rough rolling mill comprising rough rolling mills for hot rolling a material, which is heated to a predetermined temperature to a finish rolling start sheet thickness and a finish rolling mill comprising finish rolling mills for controlled-rolling the material to a final sheet thickness. At least one of the rough rolling mills is a reversible rolling mill. The production equipment line is provided on an upstream side of the reversible rolling mill with one of a slow cooling apparatus for slowly cooling at a water volume density of less than 1000 L/min·m$^2$ and a rapid cooling apparatus for rapidly cooling after the slow-
(Continued)

cooling at a water volume density of not less than 1000 L/min·m$^2$ and the other of the slow cooling apparatus and rapid cooling apparatus on a downstream side of the reversible rolling mill.

20 Claims, 7 Drawing Sheets

(51) Int. Cl.
*B21B 37/74* (2006.01)
*B21B 1/18* (2006.01)
*B21B 45/00* (2006.01)
*C21D 8/02* (2006.01)

(52) U.S. Cl.
CPC ..... *B21B 45/0218* (2013.01); *B21B 45/0233* (2013.01); *B21B 1/18* (2013.01); *B21B 45/004* (2013.01); *C21D 8/0226* (2013.01)

(58) Field of Classification Search
CPC . B21B 37/76; B21B 45/0203; B21B 45/0218; B21B 45/0233
USPC ..... 72/229
See application file for complete search history.

(56) References Cited

U.S. PATENT DOCUMENTS 5,755,128 A * 5/1998 Tippins ..... B21B 1/34 72/10.4
5,810,951 A * 9/1998 Dorricott ..... B21B 37/74 148/654
5,910,184 A * 6/1999 Kneppe ..... B21B 1/26 72/201
6,062,055 A * 5/2000 Bobig ..... B21B 1/26 72/200
6,533,876 B1 * 3/2003 Cornelissen ..... B21B 1/26 148/541
7,181,943 B2 * 2/2007 Seidel ..... B21B 37/74 72/236
8,931,321 B2 * 1/2015 Ueoka ..... B21B 45/0233 72/201
2009/0326700 A1 * 12/2009 Kurz ..... G05B 13/042 700/108
2010/0050727 A1 * 3/2010 Botta ..... B21B 39/08 72/205
2012/0260708 A1 * 10/2012 Ohara ..... B21B 37/16 72/19.7
2013/0145807 A1 * 6/2013 Benedetti ..... B21B 1/06 72/201
2013/0160277 A1 * 6/2013 Benedetti ..... B21B 1/466 29/527.7

FOREIGN PATENT DOCUMENTS

EP 1935522 A1 6/2008
JP 04274814 A 9/1992
JP 2000317501 A 11/2000
JP 2008246579 A 10/2008
JP 2008248291 A 10/2008
JP 2008290156 A 12/2008
JP 4720250 B2 7/2011
JP 2011143459 A 7/2011
JP 4946516 A 6/2012
JP 2015217411 A 12/2015
WO 2008108483 A1 9/2008

OTHER PUBLICATIONS

Chinese Office Action with Search Report for Chinese Application No. 201780008181.4, dated Apr. 8, 2019, 7 pages.
International Search Report and Written Opinion for International Application No. PCT/JP2017/001192, dated Apr. 4, 2017—4 pages.
Japanese Office Action iwth Concise Statement of Relevance of Office Action for Japanese Application No. 2016-013537, dated Jul. 5, 2017, 5 pages.
Korean Office Action for Korean Application No. 10-2018-7021493, dated Nov. 8, 2019, with Concise Statement of Relevance of Office Action, 7 pages.

* cited by examiner

PRODUCTION EQUIPMENT LINE FOR HOT-ROLLED STEEL STRIP AND PRODUCTION METHOD FOR HOT-ROLLED STEEL STRIP

CROSS REFERENCE TO RELATED APPLICATIONS

This is the U.S. National Phase application of PCT/JP2017/001192, filed Jan. 16, 2017, which claims priority to Japanese Patent Application No. 2016-013537, filed Jan. 27, 2016, the disclosures of these applications being incorporated herein by reference in their entireties for all purposes.

TECHNICAL FIELD OF THE INVENTION

This invention relates to an equipment line and a method for producing a hot-rolled steel strip in which controlled-rolling is conducted in the production of thick hot-rolled steel strips having a thickness of not less than 12 mm and requiring a high toughness.

BACKGROUND OF THE INVENTION

FIG. 1 shows a general hot rolling process. In this rolling process, a material to be rolled (slab) heated to about 1200° C. through a continuous heating furnace 1 is first forged in a widthwise direction by a sizing press 2 to adjust a sheet width and then rolled by a rough rolling mill group 3 to form a sheet bar 10 having a thickness of 30-50 mm, and subsequently the sheet bar 10 is rolled by a finish rolling mill group 6 having 6-7 stands capable of performing continuous rolling up to 1.2-25 mm to obtain a hot-rolled steel strip, which is then cooled by a runout table 7 and coiled by a coiler 8.

Since hot-rolled steel strips have hitherto been frequently used in press working, workability such as formability or the like has been considered to be important. In recent years, they has been used as a structural steel sheet represented by a linepipe or the like, so that strength and toughness are frequently required. The structural steel sheet is very thick having a thickness of 8-25 mm among the hot-rolled steel strips and particularly has a thickness of not less than 12 mm as a raw material for a linepipe. In order to increase the strength and toughness, it is advantageous to perform a controlled-rolling (CR) in the production process of the hot-rolled steel strips. The controlled-rolling has been mainly performed in the production process of thick steel plates since long ago and is a technique of increasing the toughness by rolling at a low temperature zone, where the crystal grain growth rate of steel is slow, to make crystal structure fine.

In general, a temperature for starting the controlled-rolling differs in accordance with an additive element such as Nb, V or the like and is roughly not higher than 950° C. The controlled-rolling is conducted at a rolling reduction of about at least 60% from a controlled-rolling start thickness to a product thickness. For example, when the controlled-rolling is performed at a rolling reduction of 60%, the controlled-rolling start thickness is about 30 mm in the case that the final thickness of the hot-rolled steel sheet is set to 12 mm, while the controlled-rolling start thickness is about 63 mm in the case that the final thickness is set to 25 mm. In the production process of a usual hot-rolled steel sheet, when the final thickness is set to 25 mm, there is adopted a method wherein rough rolling is first conducted to render a sheet thickness of a sheet bar into 63 mm until the end of the rough rolling and then the sheet bar is air-cooled while waiting before a finish rolling mill group 6 until a central temperature of the sheet bar arrives at not higher than 950° C. and thereafter rolled in the finish rolling mill group 6. In this case, the waiting time of the sheet bar before the finish rolling mill group 6 is required to be about 200-300 seconds, during which time a next material cannot be rolled, so that the rolling efficiency is largely decreased. As to the production line of the hot-rolled steel strip, there are only a few prior art documents for solving the above problems, but many examinations are made in the production line of thick steel sheets, and the following techniques are disclosed for example.

PRIOR ART DOCUMENTS

Patent Documents

Patent Document 1: JP-A-2011-143459
Patent Document 2: Japanese Patent No. 4720250
Patent Document 3: JP-A-H04-274814
Patent Document 4: Japanese Patent No. 4946516

TASK TO BE SOLVED BY THE INVENTION

The technique disclosed in Patent Document 1 is a method wherein a cooling apparatus of about 15-300° C./sec is arranged at an entry side or an exit side of a reversible type rough rolling mill and cooling is performed between rolling passes of the rough rolling mill, or the cooling of the material to be rolled is performed by the cooling apparatus at a stage that the sheet thickness is thicker than the controlled-rolling start thickness, whereby the controlled-rolling start temperature is set to a target value by the time of starting the controlled-rolling. However, this method has a problem that when the cooling rate is high and the sheet thickness is large, a temperature difference between the surface and the center of the steel material becomes large and hence there is a possibility that the surface layer temperature of the sheet bar may fall below a phase transformation temperature during the water cooling. In this case, only the surface layer of the sheet bar may cause phase transformation, and there is a possibility that a mechanical test value does not satisfy a given value.

The technique disclosed in Patent Document 2 is a method of simultaneously rolling plural materials to be rolled, wherein the material to be rolled is temporarily made to wait on a transporting table far removed from the rolling mill after the completion of the rolling to a thickness before the controlled-rolling, during which a next material is rolled to minimize an idling time of the rolling mill. In this technique, when the waiting time up to the start of the controlled-rolling by air cooling and the rolling time are substantially consistent, the effect of increasing the efficiency is large. However, there is a problem that when they are largely different, the rolling efficiency is not so increased.

Patent Document 3 discloses a lifting apparatus provided with a cantilever fork-shaped arm for lifting the steel sheet after the completion of the rolling before the controlled-rolling up to a height capable of passing a next material to be rolled and holding it in a waiting state. This is a very useful technique when the thickness of the sheet bar is sufficiently thick and the waiting time of the waiting sheet bar is consistent with the rolling time of the passing sheet bar. In the hot-rolled steel strip, however, a weight of a slab is as large as 20-30 tons as compared to that of the thick steel plate and the sheet bar has a very long length exceeding 20 m for example, so that a large-scale lifting apparatus is required. Also, the arm of the lifting apparatus and the sheet bar keep contact with each other for a long time, so that there is a problem that the temperature of the contact portion becomes low. Furthermore, it is suggested that the rolling can be performed with a waiting apparatus while leaving behind the next material, but it is not described how to conduct rolling in order to decrease a vacant time of a hot rolling mill to increase the rolling efficiency when a controlled-rolling material requiring waiting the cooling is included.

Patent Document 4 discloses that a water-cooling apparatus is disposed before and after the rolling mill in addition to the lifting apparatus of Patent Document 3 in order to reinforce the weakness of the above documents. Even in this patent document, however, it is not described how to conduct rolling on sheet bars of various sizes and temperature conditions in order that a vacant time of a hot rolling mill can be decreased to increase the rolling efficiency like in Patent Document 3.

It is, therefore, an object of the invention to propose a production equipment line for a hot-rolled steel strip and a production method for a hot-rolled steel strip in which a hot-rolled steel strip can be produced efficiently by decreasing a time required up to the start of the controlled-rolling while preventing the temperature of a surface layer of the sheet bar from falling below a phase transformation temperature during cooling conducted prior to the controlled rolling.

Solution for Task

A production equipment line for a hot-rolled steel strip according to the invention for advantageously solving the above task is a production equipment line for a hot-rolled steel strip comprising a rough rolling mill group comprised of plural rough rolling mills for hot rolling a material to be rolled which is heated up to a predetermined temperature to a finish rolling start sheet thickness and a finish rolling mill group comprised of plural finish rolling mills for controlled-rolling the material to be rolled to a final sheet thickness, characterized in that at least one of the plural rough rolling mills is a reversible rolling mill, and one of a slow cooling apparatus for slowly cooling the material to be rolled at a water volume density of less than 1000 L/min·m$^2$ and a rapid cooling apparatus for rapidly cooling the material to be rolled after the slow cooling at a water volume density of not less than 1000 L/min·m$^2$ is arranged on an upstream side of the reversible rolling mill, and the other of the slow cooling apparatus and the rapid cooling apparatus is arranged on a downstream side of the reversible rolling mill.

In the production equipment line for a hot-rolled steel strip according to the invention, it is preferable that at least a rough rolling mill arranged on a most downstream side among the plural rough rolling mills is a reversible rolling mill.

In the production equipment line for a hot-rolled steel strip according to the invention, it is preferable that the slow cooling apparatus is arranged on the upstream side of the reversible rolling mill and the rapid cooling apparatus is arranged on the downstream side thereof.

In the production equipment line for a hot-rolled steel strip according to the invention, it is preferable that the material to be rolled is slowly cooled by the slow cooling apparatus when the sheet thickness is not less than 80 mm and rapidly cooled by the rapid cooling apparatus when the sheet thickness is less than 80 mm.

In the production equipment line for a hot-rolled steel strip according to the invention, it is preferable that each cooling time in the slow cooling apparatus and the rapid cooling apparatus is set so as to render a surface temperature of the material to be rolled during the cooling into not lower than 600° C.

In the production equipment line for a hot-rolled steel strip according to the invention, it is preferable that a sheet thickness at an exit side of a final-stage finish rolling mill among the plural finish rolling mills is not less than 12 mm.

Also, a method for producing a hot-rolled steel strip according to the invention for advantageously solving the above task is a method for producing a hot-rolled steel strip by hot rolling a material to be rolled which is heated to a predetermined temperature by a plurality of rough rolling mills to provide a finish rolling start sheet thickness and controlled-rolling the material to be rolled to a finish sheet thickness by a plurality of finish rolling mills, characterized in that at least one of the plural rough rolling mills is a reversible rolling mill, and one of a slow cooling apparatus for slowly cooling the material to be rolled at a water volume density of less than 1000 L/min·m$^2$ and a rapid cooling apparatus for rapidly cooling the material to be rolled after the slow cooling at a water volume density of not less than 1000 L/min·m$^2$ is arranged on an upstream side of the reversible rolling mill, and the other of the slow cooling apparatus and the rapid cooling apparatus is arranged on a downstream side of the reversible rolling mill, and the material to be rolled is slowly cooled by the slow cooling apparatus at a water volume density of less than 1000 L/min·m$^2$ and thereafter the material to be rolled is rapidly cooled by the rapid cooling apparatus at a water volume density of not less than 1000 L/min·m$^2$.

In the production method for a hot-rolled steel strip according to the invention, it is preferable that at least a rough rolling mill arranged on a most downstream side among the plural rough rolling mills is a reversible rolling mill.

In the production method for a hot-rolled steel strip according to the invention, it is preferable that the slow cooling apparatus is arranged on the upstream side of the reversible rolling mill and the rapid cooling apparatus is arranged on the downstream side thereof.

In the production method for a hot-rolled steel strip according to the invention, it is preferable that the material to be rolled is slowly cooled by the slow cooling apparatus when the sheet thickness is not less than 80 mm and rapidly cooled by the rapid cooling apparatus when the sheet thickness is less than 80 mm.

In the production method for a hot-rolled steel strip according to the invention, it is preferable that the material to be rolled is cooled by the slow cooling apparatus and rapid cooling apparatus so as to render a surface temperature of the material to be rolled into not lower than 600° C. during the cooling.

In the production method for a hot-rolled steel strip according to the invention, it is preferable that a sheet thickness at an exit side of a final-stage finish rolling mill among the plural finish rolling mills is made to not less than 12 mm.

Effect of the Invention

In the production equipment line for a hot-rolled steel strip and the production method for a hot-rolled steel strip according to the invention, the material to be rolled is first slowly cooled on the upstream side or downstream side of the reversible rolling mill by the slow cooling apparatus at a water volume density of less than 1000 L/min·m$^2$ and then the material to be rolled after the slow cooling is rapidly cooled on the downstream side or the upstream side of the reversible rolling mill at a water volume density of not less than 1000 L/min·m$^2$. In an initial stage of the rolling where the sheet thickness is relatively large, the slow cooling is performed by the slow cooling apparatus in which a cooling rate is relatively small but the surface layer temperature of a sheet bar does not fall below a phase transformation temperature even in the cooling for a relatively long time, whereby a large temperature dropping quantity can be ensured while preventing phase transformation of the surface layer of the sheet bar. In a later stage of the rolling where the sheet thickness is relatively small, since a temperature difference between the center and the surface layer in the sheet bar is small and the temperature of the surface layer of the sheet bar is difficult to fall below the phase transformation temperature, a cooling rate is increased by performing the rapid cooling by the rapid cooling apparatus, whereby the sheet bar can cooled to a predetermined controlled-rolling start temperature for a short time.

In the production equipment line for a hot-rolled steel strip and the production method for a hot-rolled steel strip according to the invention, therefore, a time required up to the start of the controlled-rolling can be decreased while the temperature of the surface layer of the sheet bar is prevented from falling below the phase transformation temperature during the cooling conducted prior to the controlled-rolling, whereby hot-rolled steel strips can be produced efficiently.

EMBODIMENTS FOR CARRYING OUT THE INVENTION

Figure 1:
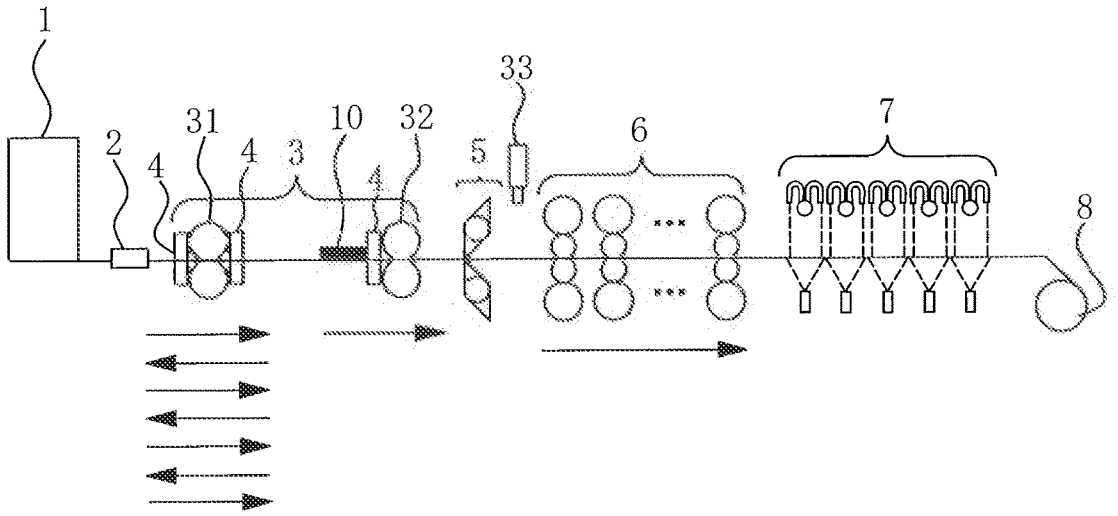
FIG. 1 is a schematic block diagram of a usual production equipment line for a hot-rolled steel strip together with a rolling pass.

A usual production equipment line and production method for a hot-rolled steel strip will be explained below, and then an embodiment of the invention will be described in detail with reference to the accompanying drawings. FIG. 1 is a schematic block diagram of a usual production equipment line for a hot-rolled steel strip together with a rolling pass.

In the production of the usual hot-rolled steel strip, as shown in FIG. 1, a material to be rolled (slab) having, for example, a sheet thickness of 260 mm is heated to 1170° C. in a continuous heating furnace 1 and then shaped into a sheet bar 10 as a sheet-like material to be rolled having a predetermined thickness by a rough rolling mill group 3. In order to adjust the sheet width of the sheet bar 10, the material to be rolled is pressed to a given size in the widthwise direction by a sizing press 2 disposed at an exit side of the continuous heating furnace 1 and further pressed also in the widthwise direction by an edger 4 disposed in a position close to a rolling mill of the rough rolling mill group 3. Next, a front edge and a tail edge of the sheet bar 10 are cut by a crop shear 5, and thereafter the sheet bar 10 is finish-rolled to a predetermined thickness (for example, 20 mm) in a finish rolling mill group 6 to form a hot-rolled steel strip, which is then cooled to a given temperature in a runout table 7 and coiled with a coiler 8.

In the illustrated example, the rough rolling mill group 3 is comprised of two rough rolling mills 31 and 32, among which a reversible rolling mill 31 capable of rolling reversibly is arranged on an upstream side (heating furnace side) of the rough rolling mill group 3 and a non-reversible rolling mill 32 capable of rolling only in a transporting direction toward a downstream side is arranged on the downstream side thereof. In the rough rolling mill group 3, for example, the rolling of about 5-11 passes is performed through the reversible rolling mill 31 and then the rolling of only 1 pass is performed through the non-reversible rolling mill 32.

Conventionally, the sheet bar 10 rolled to a predetermined controlled-rolling start thickness is kept waiting under oscillation between the rough rolling mill group 3 and the finish rolling mill group 6 until the temperature thereof is lowered to a predetermined controlled-rolling start temperature. The surface temperature of the sheet bar 10 is measured with a radiation thermometer 33. After the surface temperature of the sheet bar 10 is confirmed to be decreased to the predetermined controlled-rolling start temperature, the sheet bar is transported to the finish rolling mill group 6 to perform controlled-rolling. In this case, it is necessary to keep the sheet bar waiting for about 60-300 seconds in order to decrease the temperature by about 150-250° C. by air cooling. During this period of time, the rolling cannot be performed in the finish rolling mill group 6, leading to the decrease of the rolling efficiency. When the thickness of the sheet bar 10 is 50 mm for example, the length of the sheet bar 10 is very long being about 50 m, so that it is not realistic to introduce a mechanism such as a lifting apparatus elevating the sheet bar or the like as disclosed in Patent Documents 3 and 4.

Therefore, an embodiment of the invention adopts a construction wherein cooling and rolling in the rough rolling mill group 3 are simultaneously performed by arranging a rapid cooling apparatus 41 having a water volume density of not less than 1000 L/min·m$^2$ on an upstream side or downstream side of the reversible rolling mill 31 in the rough rolling mill group 3 and arranging a slow cooling apparatus 42 having a water volume density of less than 1000 L/min·m$^2$ on a downstream side or upstream side of the reversible rolling mill 31. Thus, the temperature of the sheet bar 10 can be adjusted so as to be equal to the controlled-rolling start temperature at a time of completing the rolling in the rough rolling mill group 3, and hence the waiting time for the controlled-rolling temperature can be largely shortened.

Figure 2:
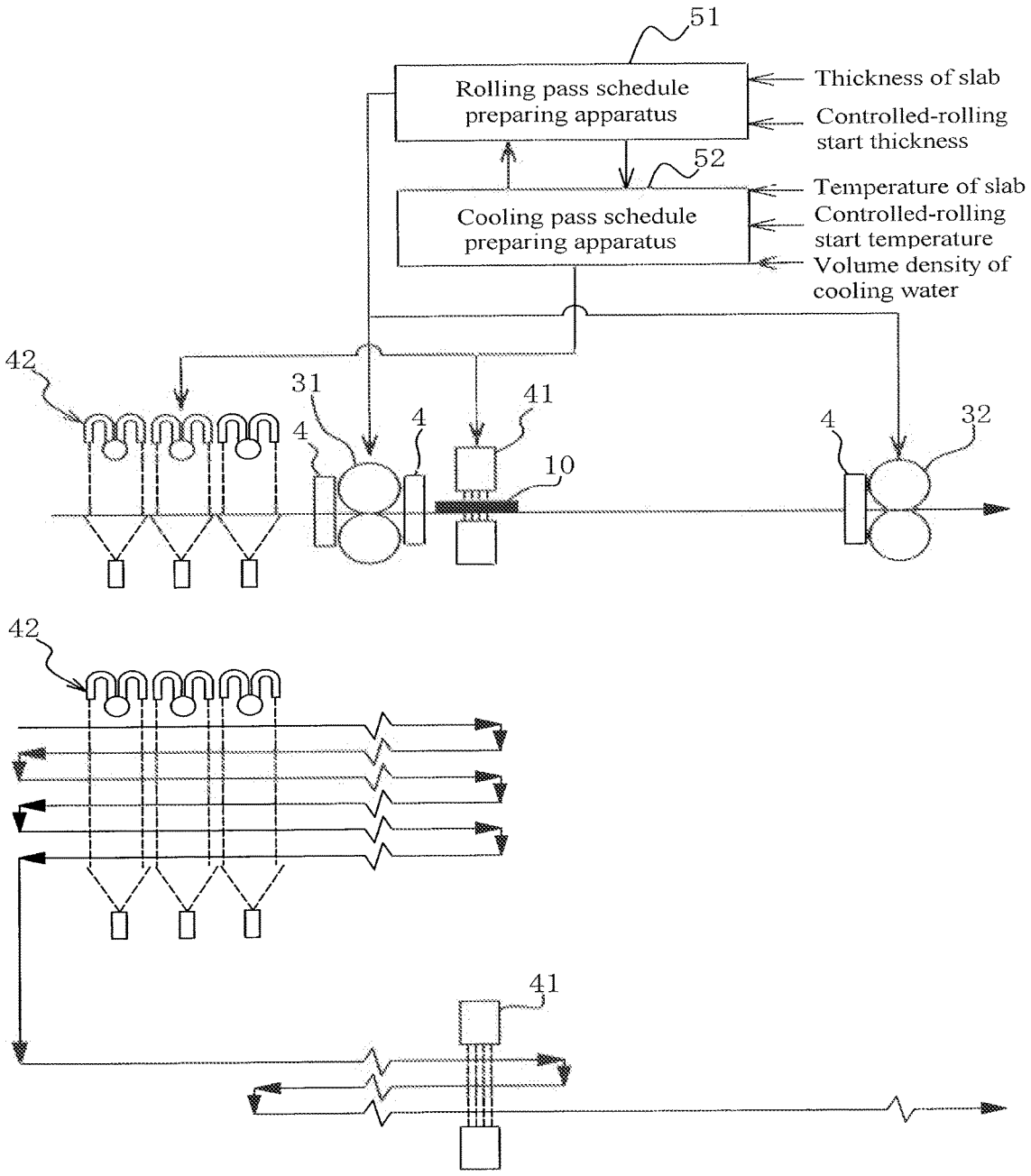
FIG. 2 is a schematic block diagram of an embodiment of the production equipment line for a hot-rolled steel strip according to the invention for carrying out an embodiment of the production method for a hot-rolled steel strip according to the invention together with a rolling pass and a cooling timing.

A concrete arrangement example of these cooling apparatuses and a rolling method using them will be described below. FIG. 2 is a block diagram schematically showing an embodiment of the production apparatus for the hot-rolled steel strip according to the invention made by adding the rapid cooling apparatus 41 and the slow cooling apparatus 42 to the production equipment line shown in FIG. 1 for performing an embodiment of the production method for the hot-rolled steel strip according to the invention.

In this embodiment, as shown in FIG. 2, the rapid cooling apparatus 41 is arranged on the downstream side of the reversible rolling mill 31, and the slow cooling apparatus 42 is arranged on the upstream side thereof. In the initial rolling, regarding an arbitrary rolling pass of the reversible rolling mill 31, as a rolling pass and a cooling timing are shown in a lower part of FIG. 2 for example, a pass-cooling of the sheet bar 10 is conducted by the slow cooling apparatus 42 before the first rolling through the reversible rolling mill 31 and between even number-th rolling passes (after the even number-th rolling and before the odd number-th rolling) through the reversible rolling mill 31. When the thickness of the sheet bar 10 reaches a predetermined thickness (late stage of rolling), discharge of water from the slow cooling apparatus 42 is stopped, while the rapid cooling apparatus 41 arranged on the downstream side of the reversible rolling mill 31 is operated to conduct a pass-cooling of the sheet bar 10 through the rapid cooling apparatus 41 in connection with the arbitrary rolling pass of the reversible rolling mill 31, for example, after the first rolling and before the second rolling in the reversible rolling mill 31 and in transfer to a non-reversible rolling mill 32.

Figure 3:
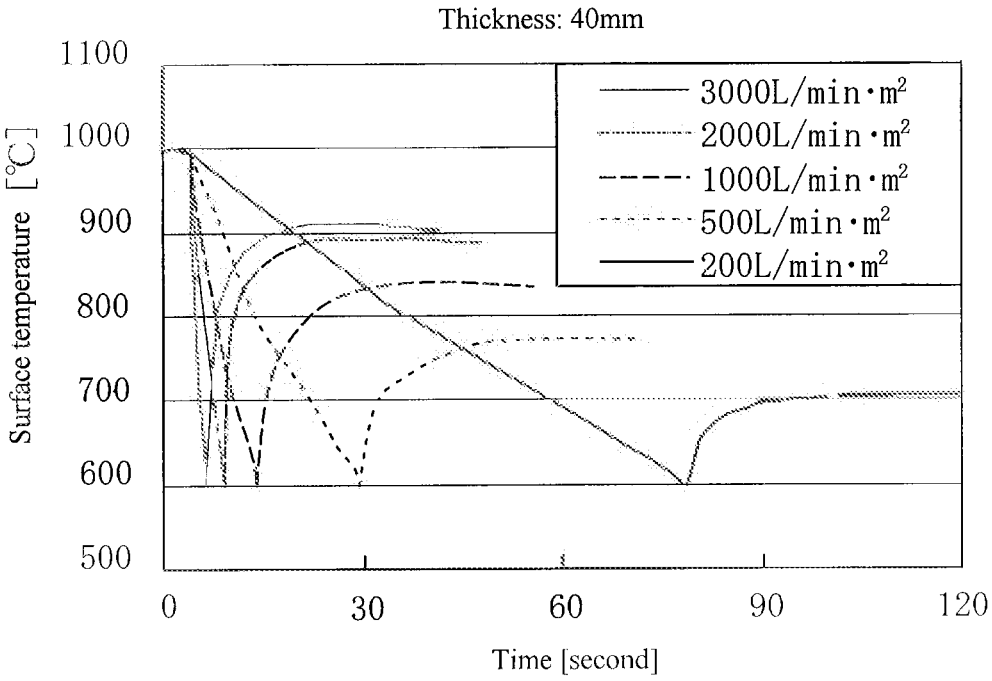
FIG. 3 is a graph showing a surface temperature history of a sheet bar when a sheet bar having a thickness of 40 mm is cooled at various volume densities of cooling water.
Figure 4:
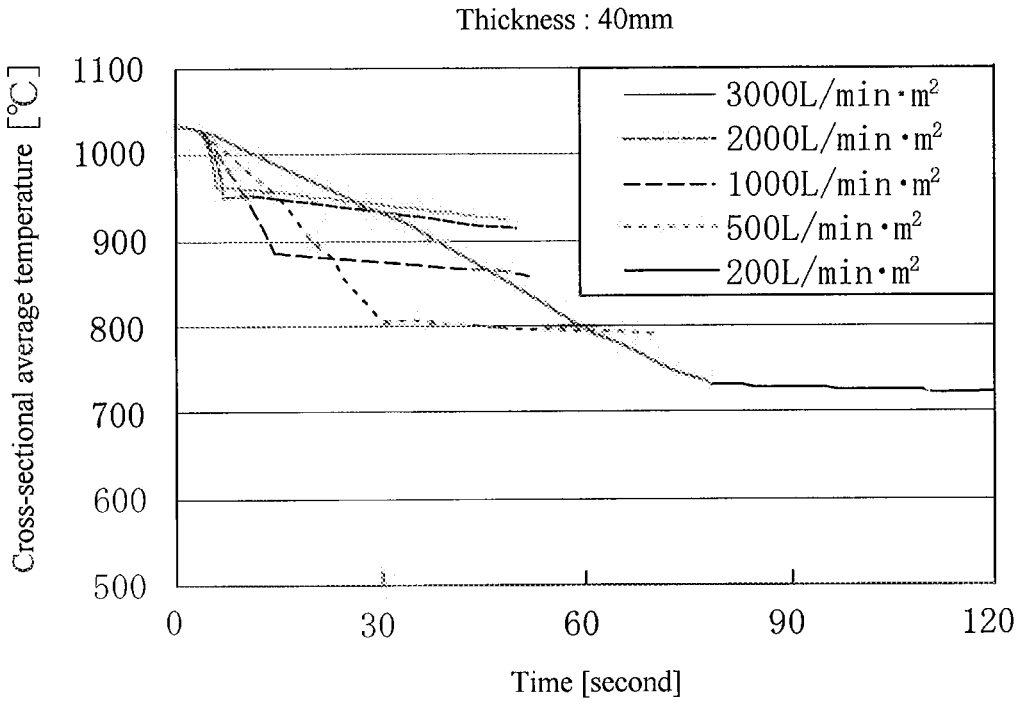
FIG. 4 is a graph showing a cross-sectional average temperature of a sheet bar when a sheet bar having a thickness of 40 mm is cooled at various volume densities of cooling water.

In this embodiment, the reason why the rapid cooling apparatus 41 and the slow cooling apparatus 42 are used properly in accordance with the thickness of the sheet bar 10, which is repeatedly rolled in the reversible rolling mill 31, is considered as follows. FIG. 3 shows a temperature history on the surface of the sheet bar 10 having a sheet thickness of 40 mm when cooled at various volume densities of cooling water as an example. In this figure, a time region where the temperature is rapidly decreased shows that water cooling is conducted, and a time region where the temperature is increased through a lower limit temperature shows that water cooling is stopped and radiation cooling (air cooling) is conducted. As seen from this figure, a cooling rate of the surface (time-gradient of temperature) becomes faster as the water volume density of cooling water is increased. On the other hand, when the temperature of the sheet bar 10 falls below 600° C., phase transformation from austenitic structure to ferritic structure is caused. When the controlled-rolling is performed at such a state, there is a risk of decreasing surface ductility to cause cracking from ferrite grain boundary. Accordingly, the temperature at an outermost surface layer of the sheet bar 10 during the water cooling is preferable to be held at not lower than 600° C. In the example shown in FIG. 3, water cooling is stopped when the surface temperature of the sheet bar 10 arrives at a lower limit temperature of 600° C. from this viewpoint. FIG. 4 shows a cross-sectional average temperature of the sheet bar 10 at that time. Similarly, a time region where the temperature is rapidly decreased shows that water cooling is conducted. When the water volume density of the cooling water is high, a time-gradient of the cross-sectional average temperature of the sheet bar 10, or a cooling rate becomes steep. However, the feed of the cooling water is stopped halfway from a viewpoint of holding the surface temperature at not lower than 600° C. to prevent cracking from ferrite grain boundary, so that the temperature at the end of cooling becomes higher as the water volume density of the cooling water becomes larger. Therefore, it can be seen that as the water volume density of the cooling water becomes smaller, the coolable temperature dropping quantity by one cooling can be increased.

Figure 5:
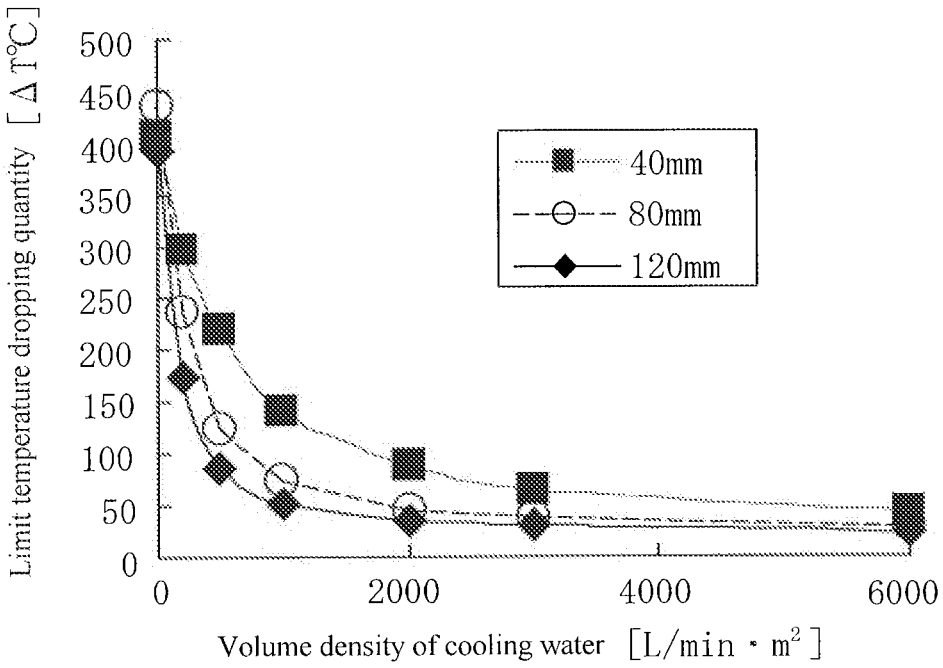
FIG. 5 is a graph showing a relation between a volume density of cooling water and a cross-sectional average limit temperature dropping quantity of a sheet bar when sheet bars having an initial surface temperature of 1000° C. and various sheet thicknesses are cooled to a sheet bar surface temperature of 600° C.

FIG. 5 shows a relation between a volume density of cooling water and a cross-sectional average temperature dropping quantity of sheet bars 10 having an initial surface temperature of 1000° C. and various sheet thicknesses when the sheet bars are cooled until the surface temperature becomes 600° C. As previously explained, since there is a restriction of holding the surface temperature at not lower than 600° C., as the sheet thickness becomes larger and as the water volume density of the cooling water becomes larger, the temperature dropping quantity by one water cooling becomes smaller. Hereinafter, the temperature difference which can be dropped by one cooling due to the restriction of holding the surface temperature at not lower than 600° C. is called as a limit temperature dropping quantity.

Figure 6:
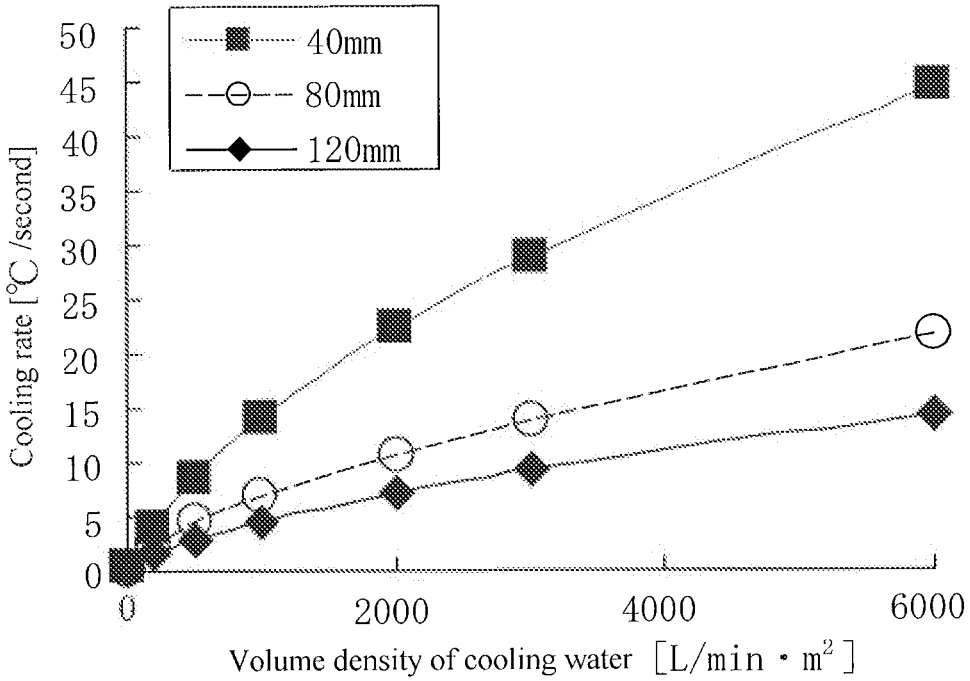
FIG. 6 is a graph showing a relation between a volume density of cooling water and a cross-sectional average cooling rate of sheet bars having an initial surface temperature of 1000° C. and various sheet thicknesses.

FIG. 6 shows a relation between a volume density of cooling water and a cross-sectional average cooling rate of sheet bars 10 having an initial surface temperature of 1000° C. and various sheet thicknesses. As the volume density of cooling water becomes larger, the cooling rate becomes faster. Considering the above restriction together, when cooling within the limit temperature dropping quantity is performed, as the water volume density of the cooling water becomes higher, the temperature can be dropped for a shorter time, which is advantageous in the shortening of the rolling time.

Considering the actual rolling process, a slab having a thickness of about 220-260 mm is rolled to about 45 mm by about 10 passes. In the initial stage of the rolling, the sheet thickness is large, so that the limit temperature dropping quantity tends to become small, and hence the slow cooling having a large limit temperature dropping quantity is advantageous from a viewpoint of a lower limit surface temperature per 1 pass. Under a condition that the sheet thickness is small in the later stage of the rolling, the limit temperature dropping quantity can be made larger, so that the rapid cooling which increases the cooling rate to perform water cooling for a short time becomes advantageous. Also, as the sheet thickness is smaller, the limit temperature dropping quantity is larger, so that when plural rough rolling mills are provided, it is preferable that the cooling is carried out on the upstream side or downstream side of the reversible rolling mill 31 arranged on a most downstream side in accordance with the smallest sheet thickness.

As seen from FIG. 5, when the sheet thickness is as relatively large as 80 mm and 120 mm, the limit temperature dropping quantity becomes larger at a low water volume density when the water volume density of cooling water is not more than 1000 L/min·m$^2$. Therefore, a large limit temperature dropping quantity can be ensured by making the water volume density of the cooling water less than 1000 L/min·m$^2$ in the case of a sheet thickness of not less than 80 mm from a viewpoint of preventing ferrite cracking in the surface of the sheet bar 10.

In the embodiment of the invention, therefore, the cooling to a given temperature desirable for the controlled-rolling (controlled-rolling start temperature) is divided into plural passes, in which the cooling within a temperature range of about 20-30° C. is performed per 1 pass. Considering the above theory, the cooling is performed by the slow cooling apparatus 42 having a water volume density of less than 1000 L/min·m$^2$ in the initial rolling in which the sheet thickness is relatively large, particularly being not less than 80 mm, while the cooling is performed by the rapid cooling apparatus 41 having a water volume density of not less than 1000 L/min·m$^2$ in the later rolling in which the sheet thickness is relatively small, particularly being less than 80 mm, whereby efficient cooling can be performed while preventing ferrite cracking on the surface of the sheet bar 10, and thus the rolling time can be shortened.

In the slow cooling apparatus 42, as the water volume density of the cooling water is decreased, the temperature dropping quantity by water cooling per 1 pass becomes larger, but the cooling rate becomes slower, and hence the effect of increasing the efficiency becomes small. Therefore, the cooling water volume by the slow cooling apparatus 42 is preferable to be not less than 200 L/min·m$^2$. In the rapid cooling apparatus 41, as the volume density of cooling water becomes larger, the temperature dropping quantity by water cooling per 1 pass becomes smaller while the cooling rate becomes faster. Therefore, the increase of the equipment cost associated with the increase of the cooling water volume is caused within a range where the critical cooling capacity per 1 pass is not much changed, so that the water volume density of the cooling water is preferable to be not more than 6000 L/min·m$^2$.

Each of the cooling apparatuses 41 and 42 may be of any system such as group jet cooling comprised of plural round nozzles, pipe laminar, mist cooling, spray cooling and so on. In the rapid cooling apparatus 41, since an amount of cooling water is large, thick retained water is liable to be generated on the sheet bar 10, and there is a possibility that stable cooling cannot be obtained because the retained water blocks collision of the jetted cooling water onto the surface of the steel sheet. Therefore, a group jet cooling apparatus having a plurality of round nozzles (a section of the nozzle may have an elliptical form or a polygonal form) with a high penetrating power to a liquid film is preferable to be used in the rapid cooling apparatus 41. In the group jet cooling apparatus, a jet flow jetted from a jetting port of each nozzle continuously travels straight, not in a spraying form or a film form, until the jet flow impinges on the surface of the steel strip, and thus a section thereof is substantially kept at a circular form. On the other hand, the slow cooling apparatus 42 has no limits, so that a pipe laminar system usually used in a cooling apparatus for hot-rolled steel strips or a spraying system can be used.

A preferable arrangement of the cooling apparatuses 41 and 42 will be described below. It is preferable that the rapid cooling apparatus 41 and the slow cooling apparatus 42 are arranged in a position nearer to the reversible rolling mill 31 as much as possible from a viewpoint of the rolling efficiency, because a time required for transferring the sheet bar 10 between the cooling apparatuses 41 and 42 and the reversible rolling mill 31 can be shortened as the rapid cooling apparatus 41 and the slow cooling apparatus 42 are arranged closer to the reversible rolling mill 31. As a cooling system by the cooling apparatuses 41 and 42 are included a stop type cooling system where the sheet bar 10 is cooled in a stopped or oscillation state and a pass type cooling system where the sheet bar 10 is cooled while passing through the cooling apparatuses 41 and 42. In the stop type cooling system, the installation length of the cooling apparatuses 41 and 42 is required to be longer than a length of the sheet bar 10, and hence the cooling apparatuses 41 and 42 are increased in size. Therefore, the cooling apparatuses 41 and 42 can be downsized by adopting the pass type cooling system and arranged closest to the reversible rolling mill 31.

The production equipment line for the hot-rolled steel strip according to this embodiment may be provided with a rolling pass schedule preparing apparatus 51 and a cooling pass schedule preparing apparatus 52 as shown in FIG. 2. The rolling pass schedule preparing apparatus 51 is constructed with a personal computer or the like, wherein pass schedules such as a rolling reduction, pass number and the like in each of the rough rolling mills 31 and 32 are calculated and prepared from the input slab thickness, controlled-rolling start thickness and the like so as to decrease the pass number within the limit of rolling reduction in each rolling pass as much as possible.

The cooling pass schedule preparing apparatus 52 is constructed with a personal computer or the like, wherein slow cooling by the slow cooling apparatus 42 is allocated in the case that the thickness of the sheet bar 10 is not less than 80 mm and rapidly cooling by the rapid cooling apparatus 41 is allocated in the case that the thickness of the sheet bar 10 is less than 80 mm to each cooling pass based on the thickness of the sheet bar 10 and the like after the each rolling pass calculated by the rolling pass schedule preparing apparatus 51, while a cooling pass number and cooling time are calculated from a relation between the volume density of cooling water and temperature dropping quantity for a predetermined sheet thickness obtained by pre-experiments or the like and a relation between the surface temperature and cooling time of a sheet bar 10 for a predetermined volume density of cooling water obtained by pre-experiments or the like. In this case, the cooling pass schedule preparing apparatus 52 calculates a cooling time and a passing rate in the slow cooling apparatus 42 and the rapid cooling apparatus 41 in such a manner so that the surface temperature of the sheet bar 10 does not fall below 600° C. during the cooling. Moreover, the cooling pass schedule prepared by the cooling pass schedule preparing apparatus 52 may be fed back to the rolling pass schedule preparing apparatus 51. When the rolling pass number is lacking for the calculated cooling pass number, a rolling pass with a rolling reduction of zero is added by the rolling pass schedule preparing apparatus 51 and water cooling may be performed after this rolling pass. The thus prepared rolling pass schedule and cooling pass schedule are output to each of the rough rolling mills 31 and 32 and cooling apparatuses 41 and 42, whereby rolling and cooling in each apparatus of 31, 32, 41, and 42 are conducted according to these schedules.

Figure 7:
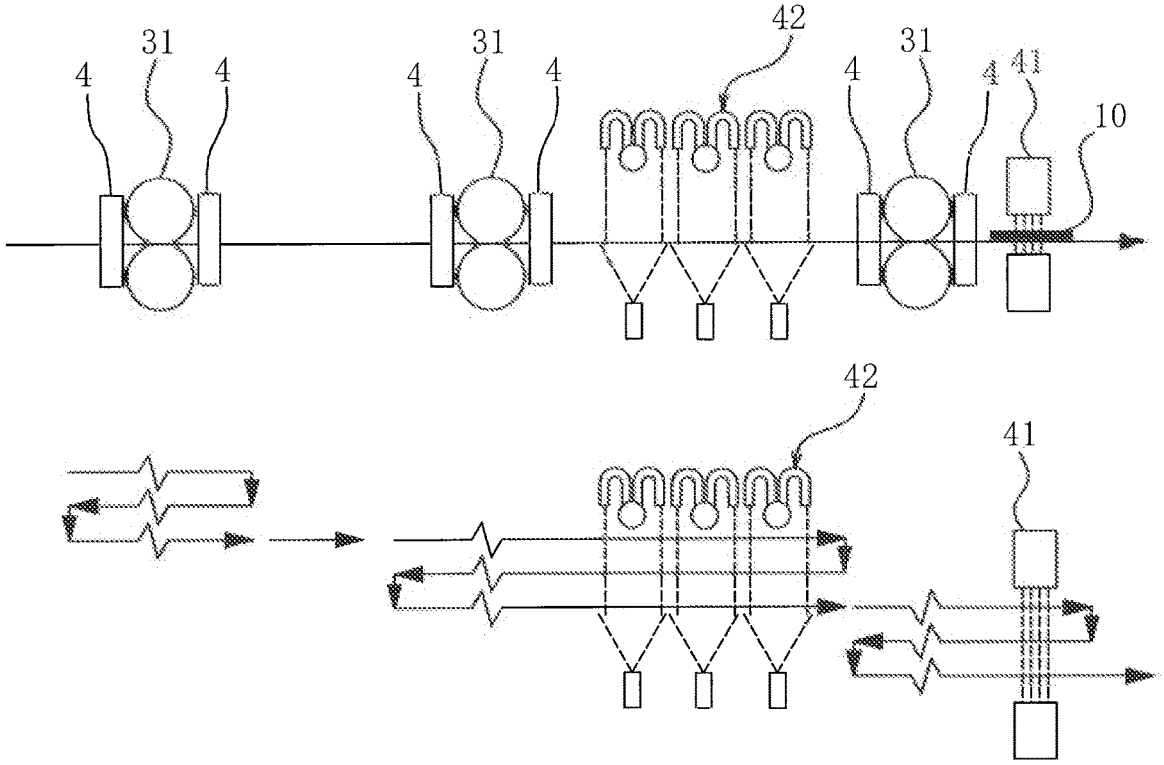
FIG. 7 is a schematic block diagram of another embodiment of the production equipment line for a hot-rolled steel strip according to the invention for carrying out another embodiment of the production method for a hot-rolled steel strip according to the invention together with a rolling pass and a cooling timing.

In the above embodiment, it is explained that the rough rolling mill group 3 is comprised of one reversible rolling mill 31 and one non-reversible rolling mill 32. However, the rough rolling mill group 3 may be provided with a plurality of reversible rolling mills 31. In FIG. 7 are shown a production equipment line for a hot-rolled steel strip according to another embodiment of the invention and a production method for a hot-rolled steel strip using the same. In this embodiment shown in the figure, the rough rolling mill group 3 is comprised of three reversible rolling mills 31. The slow cooling apparatus 42 is arranged on an upstream side of a reversible rolling mill 31 arranged at a most downstream side viewing in the rolling direction, and the rapid cooling apparatus 41 is arranged on the downstream side thereof. In a lower part of this figure is also shown a water cooling timing in the rolling process. In this production equipment line, rolling is started from the reversible rolling mill 31 arranged at a most upstream side at the left of the figure, and rolling of 3 passes is conducted in each of the reversible rolling mills 31. In this case, the most upstream reversible rolling mill 31 and the central reversible rolling mill 31 perform rolling in accordance with a rolling schedule for the sheet bar 10 having a sheet thickness of not less than 80 mm, while the most downstream reversible rolling mill 31 performs rolling in accordance with a rolling schedule for the sheet bar 10 having a sheet thickness of less than 80 mm. As shown in this figure in connection with the central reversible rolling mill 31, pass cooling can be conducted by the slow cooling apparatus 42 after the first rolling, before the second rolling and in the transfer to the most downstream reversible rolling mill 31. Thus, when the slow cooling is performed in connection with the rolling pass of the most downstream reversible rolling mill 31, it is preferable to arrange the slow cooling apparatus 42 close to the central reversible rolling mill 31. It is because a moving distance of the sheet bar 10 from the central reversible rolling mill 31 to the slow cooling apparatus 42 can be decreased to shorten the rolling time in the slow cooling.

EXAMPLE

An example according to the invention will be described below. A rolling raw material to be a target (material to be rolled) is a steel material, which has a product thickness of 15 mm or 22 mm and a controlled-rolling reduction of 65% as shown in the following Table 1. That is, a controlled-rolling start thickness is 43 mm or 63 mm. Also, a controlled-rolling start temperature is 880° C. In Comparative Examples 1 and 2 using a line shown in FIG. 1, the rolling raw material is heated to 1170° C. in a continuous heating furnace 1 and then rolled by a rough rolling mill group 3 to a controlled-rolling start thickness shown in Table 1 to form a sheet bar 10, which is subjected to rolling by a finish rolling mill group 6 after a surface temperature of the sheet bar 10 is confirmed to be 880° C.±5° C. by means of a radiation thermometer 33. When the temperature of the sheet bar 10 is higher than a target controlled-rolling start temperature, the sheet bar 10 is kept waiting between the rough rolling mill group 3 and the finish rolling mill group 6 under oscillation until a predetermined controlled-rolling start temperature is obtained.

TABLE 1

| | Heating temperature | Product thickness | Controlled-rolling start thickness (Thickness before finish rolling) | Controlled-rolling start temperature (Finish rolling temperature) | Slow cooling apparatus | Rapid cooling apparatus |
|---|---|---|---|---|---|---|
| Example 1 | 1170° C. | 15 mm | 43 mm | 880° C. | Use | Use |
| Example 2 | 1170° C. | 22 mm | 63 mm | 880° C. | Use | Use |
| Comparative Example 1 | 1170° C. | 15 mm | 43 mm | 880° C. | No use | No use |
| Comparative Example 2 | 1170° C. | 22 mm | 63 mm | 880° C. | No use | No use |

In Examples 1 and 2, water cooling is performed in a rough rolling process by arranging a slow cooling apparatus 42 on an upstream side and a rapid cooling apparatus 41 on a downstream side of a reversible rolling mill 31 in a rough rolling mill group 3, as shown in FIG. 2. The rolling and water cooling in Example 1 are conducted according to a pass schedule described in Table 2, while the rolling and cooling in Example 2 are conducted according to a pass schedule described in Table 3. Similarly, rolling in Comparative Example 1 and rolling in Comparative Example 2 are conducted according to the pass schedule of Table 2 and the pass schedule of Table 3 respectively, and water cooling is not conducted in Comparative Examples.

TABLE 2

| Rolling pass | Rolling mill No. | Type of rolling mill | Rolling direction | Thickness after rolling mm | Cooling pass | Cooling apparatus |
|---|---|---|---|---|---|---|
| 1 | 1 | Reversible type | Downstream side | 230 | Absence | — |
| 2 | 1 | Reversible type | Upstream side | 190 | Presence (twice) | Slow cooling apparatus |
| 3 | 1 | Reversible type | Downstream side | 150 | Absence | — |
| 4 | 1 | Reversible type | Upstream side | 120 | Presence (twice) | Slow cooling apparatus |
| 5 | 1 | Reversible type | Downstream side | 90 | Absence | — |

TABLE 2-continued

| Rolling pass | Rolling mill No. | Type of rolling mill | Rolling direction | Thickness after rolling mm | Cooling pass | Cooling apparatus |
|---|---|---|---|---|---|---|
| 6 | 1 | Reversible type | Upstream side | 85 | Presence (twice) | Slow cooling apparatus- |
| 7 | 1 | Reversible type | Downstream side | 75 | Presence (twice) | Rapid cooling apparatus |
| 8 | 1 | Reversible type | Upstream side | 65 | Absence | — |
| 9 | 1 | Reversible type | Downstream side | 54 | Presence (once) | Rapid cooling apparatus |
| 10 | 2 | Non-reversible type | Downstream side | 43 | Absence | — |

TABLE 3

| Rolling pass | Rolling mill No. | Type of rolling mill | Rolling direction | Thickness after rolling mm | Cooling pass | Cooling apparatus |
|---|---|---|---|---|---|---|
| 1 | 1 | Reversible type | Downstream side | 230 | Absence | — |
| 2 | 1 | Reversible type | Upstream side | 190 | Presence(twice) | Slow cooling apparatus |
| 3 | 1 | Reversible type | Downstream side | 160 | Absence | — |
| 4 | 1 | Reversible type | Upstream side | 130 | Presence(twice) | Slow cooling apparatus |
| 5 | 1 | Reversible type | Downstream side | 105 | Absence | — |
| 6 | 1 | Reversible type | Upstream side | 87 | Presence(twice) | Slow cooling apparatus |
| 7 | 1 | Reversible type | Downstream side | 72 | Presence(once) | Rapid cooling apparatus |
| 8 | 2 | Non-reversible type | Downstream side | 63 | Absence | — |

In the rapid cooling apparatus 41 is used a group jet cooling apparatus constructed by arranging a plurality of round tube nozzles with a hole diameter of 5 mm at a pitch of 60 mm in a transportation direction (rolling direction) and a widthwise direction, in which a volume density of cooling water is 2500 L/min·m$^2$. In the slow cooling apparatus 42 are used a hairpin type pipe laminar cooling apparatus disposed at an upper face side of the sheet bar 10 and a spray cooling apparatus disposed at a lower face side of the sheet bar 10, in which a volume density of cooling water is 800 L/min·m$^2$. Further, a rolling rate and a rate passing through the cooling apparatus are controlled so as to render the surface temperature of the sheet bar 10 during the cooling into not lower than 600° C.

In Table 4 are shown results obtained by actually rolling the rolling raw materials of Examples 1 and 2 and Comparative Examples 1 and 2 under the aforementioned conditions. Example 1 is a case where the product thickness is 15 mm, in which a waiting time before the finish rolling mill group 6 is about 10 seconds and a total of the waiting time and the rough rolling time is 462 seconds. Moreover, the waiting time of 10 seconds is a time required for confirming a temperature by means of a radiation thermometer 33 before the finish rolling mill group 6, so that a real waiting time is not caused. In Comparative Example 1, the rolling is performed according to the same rolling pass schedule as in Example 1, but the cooling apparatuses 41 and 42 proposed in the present invention is not used, so that a temperature of the sheet bar 10 when arriving at the finish rolling mill group 6 is 948° C., which is higher by 68° C. than a target temperature of 880° C., and hence the sheet bar is kept waiting (air cooled) for 95 seconds before the finish rolling mill group 6 until the target temperature is obtained. A total of the waiting time and the rough rolling time is 516 seconds, which is longer by 54 seconds than that in Example 1.

TABLE 4

| | Rough rolling pass schedule | Use of cooling apparatus | Temperature at entry side of finish rolling mill: On arrival | Temperature at entry side of finish rolling mill: Rolling start | Waiting time before finish rolling mill | Rough rolling time (take out from heating furnace - before finish rolling) | Waiting time + rough rolling time |
|---|---|---|---|---|---|---|---|
| Example 1 | Table 1 | Use | 887° C. | 881° C. | 10 sec | 452 sec | 462 sec |
| Example 2 | Table 2 | Use | 883° C. | 882° C. | 10 sec | 446 sec | 456 sec |

TABLE 4-continued

| | Rough rolling pass schedule | Use of cooling apparatus | Temperature at entry side of finish rolling mill: On arrival | Temperature at entry side of finish rolling mill: Rolling start | Waiting time before finish rolling mill | Rough rolling time (take out from heating furnace - before finish rolling) | Waiting time + rough rolling time |
|---|---|---|---|---|---|---|---|
| Comparative Example 1 | Table 1 | No use | 948° C. | 882° C. | 95 sec | 421 sec | 516 sec |
| Comparative Example 2 | Table 2 | No use | 989° C. | 881° C. | 221 sec | 356 sec | 576 sec |

Example 2 is a case where the product thickness is 22 mm. The waiting time before the finish rolling mill group 6 is about 10 seconds as in Example 1, and a total of the waiting time and the rough rolling time is 456 seconds, which is approximately the same rolling time as in Example 1. Moreover, the waiting time of 10 seconds is a time required for confirming a temperature by means of a radiation thermometer 33 before the finish rolling mill group 6, so that a real waiting time is not caused.

In Comparative Example 2, the rolling is conducted according to the same rolling pass schedule as in Example 2. However, the cooling apparatuses 41 and 42 proposed in the present invention are not used in Comparative Example 2, so that a temperature of the sheet bar 10 when arriving at the finish rolling mill group 6 is 989° C., which is higher by 109° C. than a target temperature of 880° C., and hence the sheet bar is kept waiting (air cooled) for 221 seconds before the finish rolling mill group 6 until the target temperature is obtained. A total of the waiting time and the rough rolling time is 576 seconds, which is longer by 120 seconds than that in Example 2.

From the above experimental results, it has been confirmed that a time from when the sheet bar is taken out from the heating furnace to when the finish rolling is started is shortened by 54 seconds in the case of the material for the product thickness of 15 mm and by 120 seconds in the case of the material for the product thickness of 22 mm by arranging the rapid cooling apparatus 41 and the slow cooling apparatus 42 in the rough rolling mill group 3 and properly using the rapid cooling and the slow cooling in accordance with the thickness of the sheet bar 10.

The invention is described based on the above illustrated examples. However, the invention is not limited thereto, so that proper modifications and addition may be performed within a scope described in claims. For example, the cooling by the rapid cooling apparatus 41 and the slow cooling apparatus 42 may not be performed in connection with all of odd number-th or even number-th rolling passes in the reversible rolling mill 31. When the temperature dropping quantity by the water cooling is large and the temperature when arriving at the finish rolling mill falls below the predetermined start temperature of the finish rolling, water cooling in arbitrary pass may not be performed. In the above explanation, the slow cooling apparatus 42 is arranged on the upstream side of the most downstream reversible rolling mill 31 viewing in the rolling direction, and the rapid cooling apparatus 41 is arranged on the downstream side thereof. However, the rapid cooling apparatus 41 may be arranged on the upstream side of the reversible rolling mill 31 and the slow cooling apparatus 42 may be arranged on the downstream side thereof.

INDUSTRIAL APPLICABILITY

According to the invention, hot-rolled steel strips can be produced efficiently while preventing the temperature of the surface layer of the sheet bar from falling below a phase transformation temperature during the cooling conducted prior to the controlled-rolling and decreasing a time required up to starting the controlled-rolling.

DESCRIPTION OF REFERENCE SYMBOLS

1 continuous heating furnace
2 sizing press
3 rough rolling mill group
4 edger
5 crop shear
6 finish rolling mill group
7 runout table
8 coiler
10 sheet bar
31 reversible rolling mill
32 non-reversible rolling mill
33 radiation thermometer
41 rapid cooling apparatus
42 slow cooling apparatus
51 rolling pass schedule preparing apparatus
52 cooling pass schedule preparing apparatus

The invention claimed is:

1. A production equipment line for a hot-rolled steel strip comprising a rough rolling mill group comprised of plural rough rolling mills for hot rolling a material to be rolled which is heated up to a predetermined temperature to a finish rolling start sheet thickness and a finish rolling mill group comprised of plural finish rolling mills for controlled-rolling the material to be rolled to a final sheet thickness, characterized in that at least one of the plural rough rolling mills is a reversible rolling mill, and one of a slow cooling apparatus for slowly cooling the material to be rolled at a water volume density of less than 1000 L/min·m$^2$ or a rapid cooling apparatus for rapidly cooling the material to be rolled after the slow cooling at a water volume density of not less than 1000 L/min·m$^2$ is arranged on an upstream side of the reversible rolling mill and the other of the slow cooling apparatus or the rapid cooling apparatus is arranged on a downstream side of the reversible rolling mill, such that at least one of the slow cooling apparatus and the rapid cooling apparatus is arranged between the reversible rolling mill and another one of the plural rough rolling mills.

2. The production equipment line for a hot-rolled steel strip according to claim 1, wherein at least a rough rolling mill arranged on a most downstream side among the plural rough rolling mills is a reversible rolling mill.

3. The production equipment line for a hot-rolled steel strip according to claim 1, wherein the slow cooling apparatus is arranged on the upstream side of the reversible rolling mill and the rapid cooling apparatus is arranged on the downstream side thereof.

4. The production equipment line for a hot-rolled steel strip according to claim 2, wherein the slow cooling apparatus is arranged on the upstream side of the reversible rolling mill and the rapid cooling apparatus is arranged on the downstream side thereof.

5. The production equipment line for a hot-rolled steel strip according to claim 1, wherein the slow cooling apparatus is positioned relative to the plural rough rolling mills such that the material to be rolled is slowly cooled by the slow cooling apparatus when the sheet thickness is not less than 80 mm and the rapid cooling apparatus is positioned relative to the plural rough rolling mills such that the material to be rolled is rapidly cooled by the rapid cooling apparatus when the sheet thickness is less than 80 mm.

6. The production equipment line for a hot-rolled steel strip according to claim 2, wherein the slow cooling apparatus is positioned relative to the plural rough rolling mills such that the material to be rolled is slowly cooled by the slow cooling apparatus when the sheet thickness is not less than 80 mm and the rapid cooling apparatus is positioned relative to the plural rough rolling mills such that the material to be rolled is rapidly cooled by the rapid cooling apparatus when the sheet thickness is less than 80 mm.

7. The production equipment line for a hot-rolled steel strip according to claim 3, wherein the slow cooling apparatus is positioned relative to the plural rough rolling mills such that the material to be rolled is slowly cooled by the slow cooling apparatus when the sheet thickness is not less than 80 mm and the rapid cooling apparatus is positioned relative to the plural rough rolling mills such that the material to be rolled is rapidly cooled by the rapid cooling apparatus when the sheet thickness is less than 80 mm.

8. The production equipment line for a hot-rolled steel strip according to claim 4, wherein the slow cooling apparatus is positioned relative to the plural rough rolling mills such that the material to be rolled is slowly cooled by the slow cooling apparatus when the sheet thickness is not less than 80 mm and the rapid cooling apparatus is positioned relative to the plural rough rolling mills such that the material to be rolled is rapidly cooled by the rapid cooling apparatus when the sheet thickness is less than 80 mm.

9. The production equipment line for a hot-rolled steel strip according to claim 1, wherein each cooling time in the slow cooling apparatus and the rapid cooling apparatus is set so as to render a surface temperature of the material to be rolled during the cooling into not lower than 600° C.

10. The production equipment line for a hot-rolled steel strip according to claim 1, wherein a sheet thickness at an exit side of a final-stage finish rolling mill among the plural finish rolling mills is not less than 12 mm.

11. A method for producing a hot-rolled steel strip by hot rolling a material to be rolled which is heated to a predetermined temperature by a plurality of rough rolling mills to provide a finish rolling start sheet thickness and controlled-rolling the material to be rolled to a finish sheet thickness by a plurality of finish rolling mills, characterized in that at least one of the plural rough rolling mills is a reversible rolling mill, and one of a slow cooling apparatus for slowly cooling the material to be rolled at a water volume density of less than 1000 L/min·m$^2$ or a rapid cooling apparatus for rapidly cooling the material to be rolled at a water volume density of not less than 1000 L/min·m$^2$ is arranged on an upstream side of the reversible rolling mill and the other of the slow cooling apparatus or the rapid cooling apparatus is arranged on a downstream side of the reversible rolling mill, such that at least one of the slow cooling apparatus and the rapid cooling apparatus is arranged between the reversible rolling mill and another one of the plural rough rolling mills, and the material to be rolled is slowly cooled by the slow cooling apparatus at a water volume density of less than 1000 L/min·m$^2$ and thereafter the material to be rolled is rapidly cooled by the rapid cooling apparatus at a water volume density of not less than 1000 L/min·m$^2$.

12. The production method for a hot-rolled steel strip according to claim 11, wherein at least a rough rolling mill arranged on a most downstream side among the plural rough rolling mills is a reversible rolling mill.

13. The production method for a hot-rolled steel strip according to the claim 11, wherein the slow cooling apparatus is arranged on the upstream side of the reversible rolling mill and the rapid cooling apparatus is arranged on the downstream side thereof.

14. The production method for a hot-rolled steel strip according to the claim 12, wherein the slow cooling apparatus is arranged on the upstream side of the reversible rolling mill and the rapid cooling apparatus is arranged on the downstream side thereof.

15. The production method for a hot-rolled steel strip according to claim 11, wherein the material to be rolled is slowly cooled by the slow cooling apparatus when the sheet thickness is not less than 80 mm and rapidly cooled by the rapid cooling apparatus when the sheet thickness is less than 80 mm.

16. The production method for a hot-rolled steel strip according to claim 12, wherein the material to be rolled is slowly cooled by the slow cooling apparatus when the sheet thickness is not less than 80 mm and rapidly cooled by the rapid cooling apparatus when the sheet thickness is less than 80 mm.

17. The production method for a hot-rolled steel strip according to claim 13, wherein the material to be rolled is slowly cooled by the slow cooling apparatus when the sheet thickness is not less than 80 mm and rapidly cooled by the rapid cooling apparatus when the sheet thickness is less than 80 mm.

18. The production method for a hot-rolled steel strip according to claim 14, wherein the material to be rolled is slowly cooled by the slow cooling apparatus when the sheet thickness is not less than 80 mm and rapidly cooled by the rapid cooling apparatus when the sheet thickness is less than 80 mm.

19. The production method for a hot-rolled steel strip according to claim 11, wherein the material to be rolled is cooled by the slow cooling apparatus and rapid cooling apparatus so as to render a surface temperature of the material to be rolled into not lower than 600° C. during the cooling.

20. The production method for a hot-rolled steel strip according to claim 11, wherein a sheet thickness at an exit side of a final-stage finish rolling mill among the plural finish rolling mills is not less than 12 mm.

* * * * *